US005809697A

United States Patent [19]

Chen

[11] Patent Number: 5,809,697

[45] Date of Patent: Sep. 22, 1998

[54] DOOR CLOSER

[76] Inventor: Wen Hua Chen, P. O. Box 82-144, Taipei, Taiwan

[21] Appl. No.: 798,997

[22] Filed: Feb. 7, 1997

[51] Int. Cl.[6] ..... E05F 1/10

[52] U.S. Cl. ..... 49/386; 49/379; 49/451; 74/89.18; 185/39; 185/45

[58] Field of Search ..... 49/386, 341, 342, 49/343, 362, 363, 379, 371, 451; 16/76, 77; 74/89, 89.13, 89.18; 185/39, 45

[56] References Cited

U.S. PATENT DOCUMENTS

| | | | |
|---|---|---|---|
| 60,954 | 1/1867 | Stephenson | 16/77 |
| 154,097 | 8/1874 | Steed et al. | 16/77 |
| 333,565 | 1/1886 | Stevens | 49/451 |
| 465,307 | 12/1891 | Woods | 16/77 |
| 643,970 | 2/1900 | McFeely | 16/77 |
| 1,080,567 | 12/1913 | Lampe | 16/77 |
| 1,177,990 | 4/1916 | Carroll | 49/379 |
| 1,178,416 | 4/1916 | Schmucker | 16/77 |
| 1,284,518 | 11/1918 | Whitworth | 49/451 |
| 1,920,397 | 8/1933 | Johnson | 49/386 |
| 2,019,526 | 11/1935 | Ellison | 49/386 |
| 2,258,948 | 10/1941 | Garrison | 49/386 |
| 3,055,064 | 9/1962 | Riegelman | 49/451 |
| 3,095,617 | 7/1963 | Bruno | 49/451 |
| 5,579,606 | 12/1996 | Kim | 49/386 |

FOREIGN PATENT DOCUMENTS

| | | | |
|---|---|---|---|
| 2663709 | 12/1991 | France | 74/89.18 |
| 406109090 | 4/1994 | Japan | 74/89.18 |

*Primary Examiner*—Daniel P. Stodola
*Assistant Examiner*—Curtis Cohen

[57] ABSTRACT

A door closer includes a casing fixedly fastened to a door leaf, a shaft turned in axle holes in the casing, a spiral spring mounted around the shaft within the casing and having one end fixed to the shaft and an opposite end fixed to the casing and adapted for returning the door leaf to the close position each time it is opened, a rack fixedly fastened to a door frame to which the door leaf is hinged, a bevel gear fixedly mounted on one end of the shaft and turned with it along a 90-degree arc toothed bar section of the rack, and a curved springy holding down plate fastened to the rack and adapted for holding down the bevel gear to keep the door leaf to be retained in an open position.

2 Claims, 7 Drawing Sheets

DOOR CLOSER

BACKGROUND OF THE INVENTION

1. Field of the Invention

This invention relates to door closers, and more particularly to such a door closer which uses a spiral spring to return the door leaf, a gear and rack assembly to guide the movement of the door leaf, and a curved springy holding down plate to releasably hold the door leaf in an open position.

2. Description of the Prior Art

FIGS. 7 and 8 show a door closer according to the prior art. This structure of door closer automatically closes the hinged door leaf 71 each time the hinged door leaf 71 is opened from the door frame 81. However, this structure of door closer has drawbacks. Because this door closer uses torsional springs to impart a return force to the hinged door leaf 71, a sudden force is given to the hinged door leaf 71 each time the hinged door leaf 71 is opened, and the hinged door leaf 71 will be closed in a rush, causing a loud noise to be produced. Another drawback of this structure of door closer is that the door leaf 71 cannot be held in an open position. When the door leaf 71 is released from the hand, it is immediately forced back to the close position. Furthermore, this structure of door closer is not suitable for use in a sliding door.

SUMMARY OF THE INVENTION

This invention relates to door closers, and more particularly to such a door closer which uses a spiral spring to return the door leaf, a gear and rack assembly to guide the movement of the door leaf, and a curved springy holding down plate to releasably hold the door leaf in an open position. According to one aspect of the present invention, the door closer is comprised of a casing fixedly fastened to a door leaf, a shaft turned in axle holes in the casing, a spiral spring mounted around the shaft within the casing and having one end fixed to the shaft and an opposite end fixed to the casing and adapted for returning the door leaf to the close position each time it is opened, a curved rack fixedly fastened to a door frame to which the door leaf is hinged, and a bevel gear fixedly mounted on one end of the shaft and turned with it along a 90-degree arc toothed bar section of the rack. Because the bevel gear is meshed with the 90-degree arc toothed bar section of the rack, the door leaf is not returned in a rush. According to another aspect of the present invention, a curved springy holding down plate is provided having a fixed end fastened to the rack, and wave-like free end adapted for holding down the bevel gear to keep the door leaf to be retained in an open position. As an alternate form of the present invention, a straight rack and a regular gear are respectively used to replace the aforesaid curved rack and bevel gear, so that the door closer can be used in a sliding door.

DETAILED DESCRIPTION OF THE PREFERRED EMBODIMENT

Figure 1:
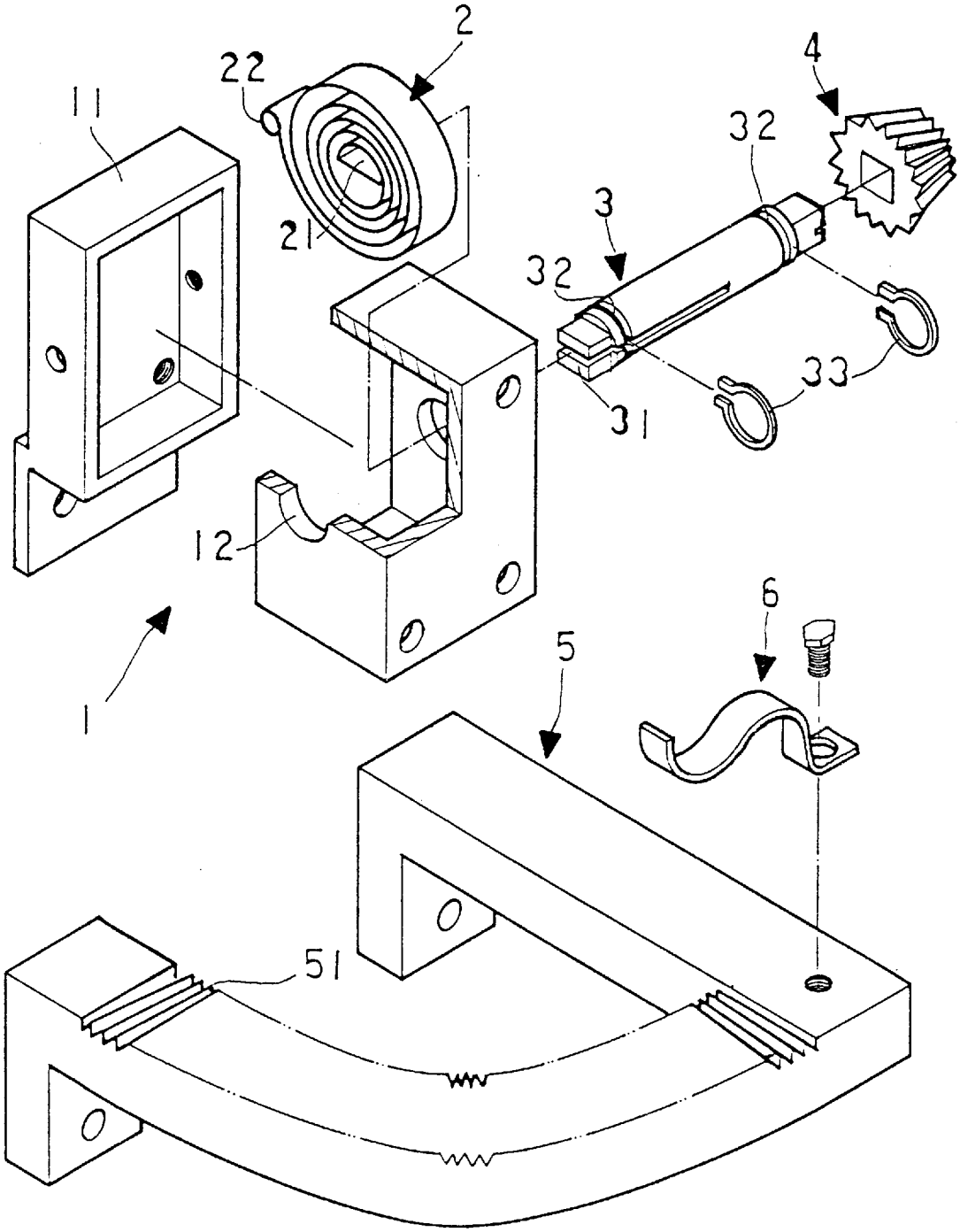
FIG. 1 is an exploded view of a door closer according to a first embodiment of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIG. 1, a door closer in accordance with the present invention is generally comprised of a casing 1, a spiral spring 2, a shaft 3, a bevel gear 4, a rack 5, and a curved springy holding down plate 6.

Figure 2:
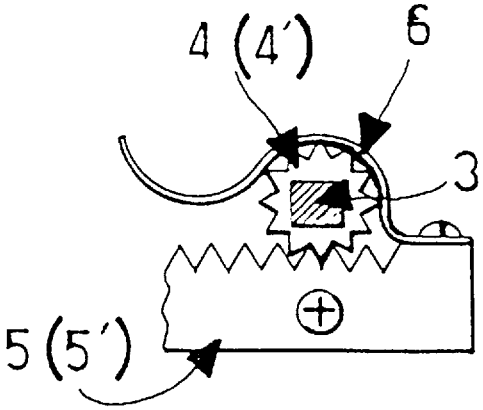
FIG. 2 is a sectional view of a part of the present invention, showing the gear forced into engagement with the springy holding down plate.
Figure 3:
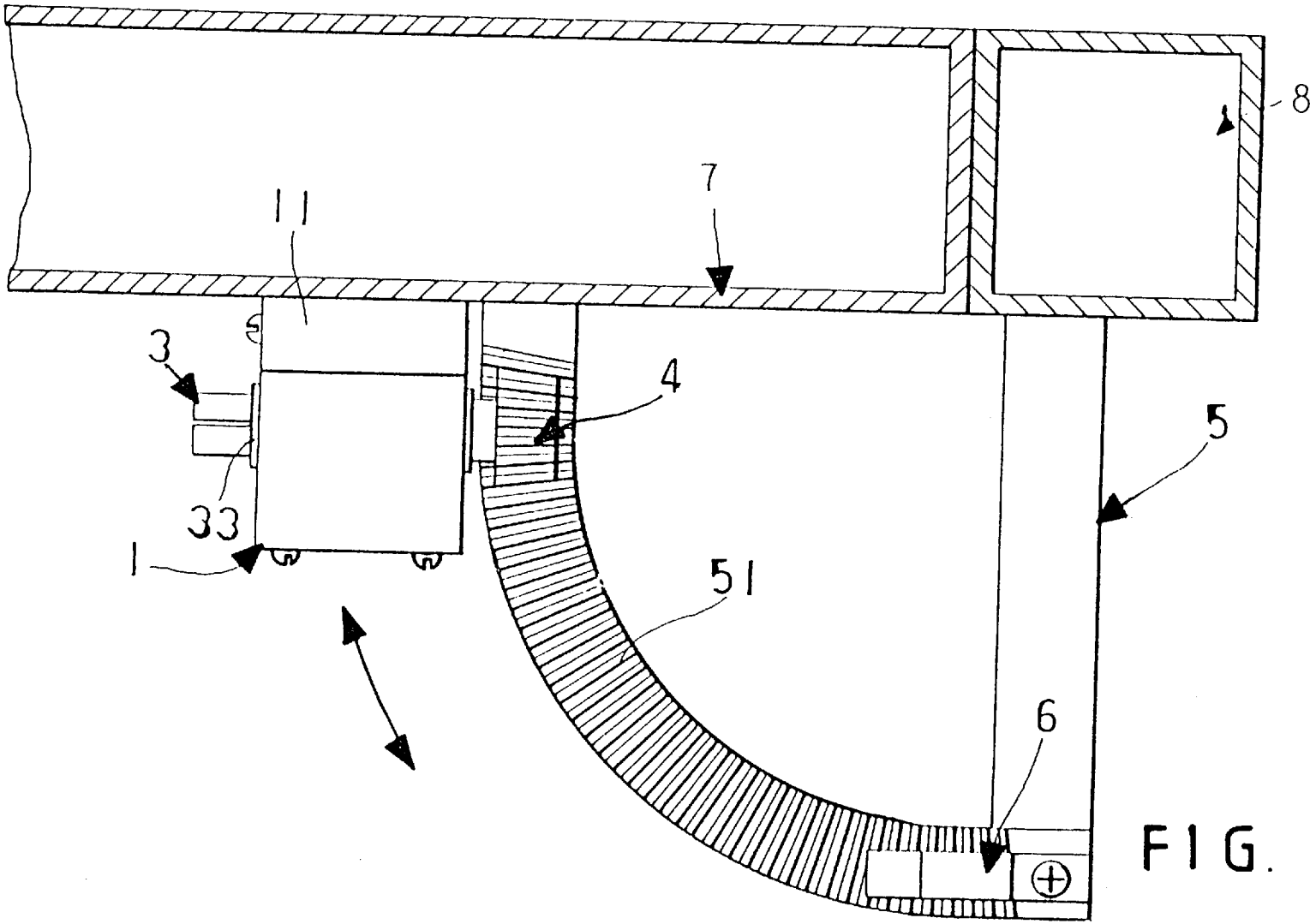
FIG. 3 is a sectional view showing the door closer of the first embodiment of the present invention installed.

Referring to FIGS. 2 and 3, and FIG. 1 again, the casing 1 is fastened to the door leaf 7 at a suitable location and covered with a cover 11, having two axle holes 12 aligned at two opposite sides. The spiral spring 2 is mounted within the casing 1 around the shaft 3, having an inner end terminating in a flat plug portion 21 coupled to the shaft 3, and an outer end terminating into a barrel-like mounting portion 22 fastened with the casing 1 to the door leaf 7. The shaft 3 is turned in the axle holes 12 of the casing 1, having two annular grooves 32 around the periphery near two opposite ends, and a longitudinal split 31 extended from a middle part to one end. When the shaft 3 is inserted through the axle holes 12 of the casing 1, the spiral spring 2 is mounted within the casing 1 around the shaft 3 and the flat plug portion 21 of the spiral spring 2 is transversely plugged into the longitudinal split 31 of the shaft 3, and then two clamps 33 are respectively fastened to the annular grooves 32 of the shaft 3 to secure the shaft 3, the spiral spring 2 and the casing 1 together. The bevel gear 4 is mounted around one end of the shaft 3 and turned with it. The rack 5 is fixedly fastened to the door frame (door jamb) 8 adjacent to the casing 1, having a 90-degree arc toothed bar section 51 meshed with the bevel gear 4. When the door leaf 7 is opened, the bevel gear 4 is moved along the 90-degree arc toothed bar section 51 in one direction, and the shaft 3 is turned with the bevel gear 4 to tighten up the spiral spring 2. When the door leaf 7 is released from the hand, the shaft 3 is turned by the spring force of the spiral spring 2 in the reversed direction, causing the bevel gear 4 to be moved along the 90:-arc toothed bar section 51 in reversed direction, and therefore the door leaf 7 is closed smoothly. This arrangement does not cause the door leaf 7 to be closed in a rush. Further, the curved springy holding down plate 6 has a wave-like shape, and a fixed end fixedly fastened to the rack 5. When the door leaf 7 is opened to 90:, the bevel gear 4 is forced into engagement with the curved springy holding down plate 6 (see FIG. 2), and therefore the door leaf 7 is retained in the 90-degree open position. When the door leaf 7 is pushed back, the bevel gear 4 is forced away from the locating plate 6 and moved turned with the shaft 3 along the 90-degree arc toothed bar section 51 to pull the door leaf 7 to the closed status.

Figure 5:
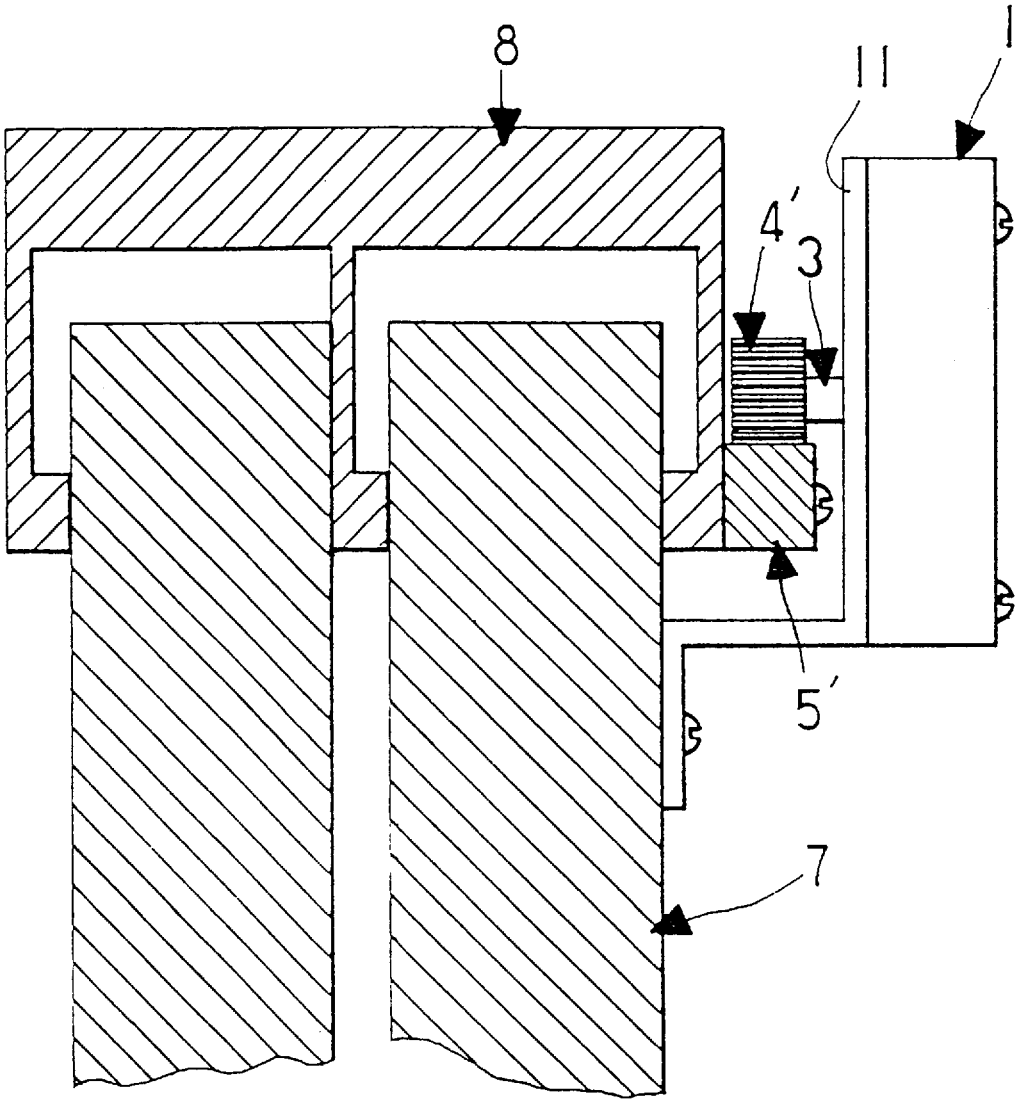
FIG. 5 is a sectional view showing the door closer of the second embodiment of the present invention installed.
Figure 4:
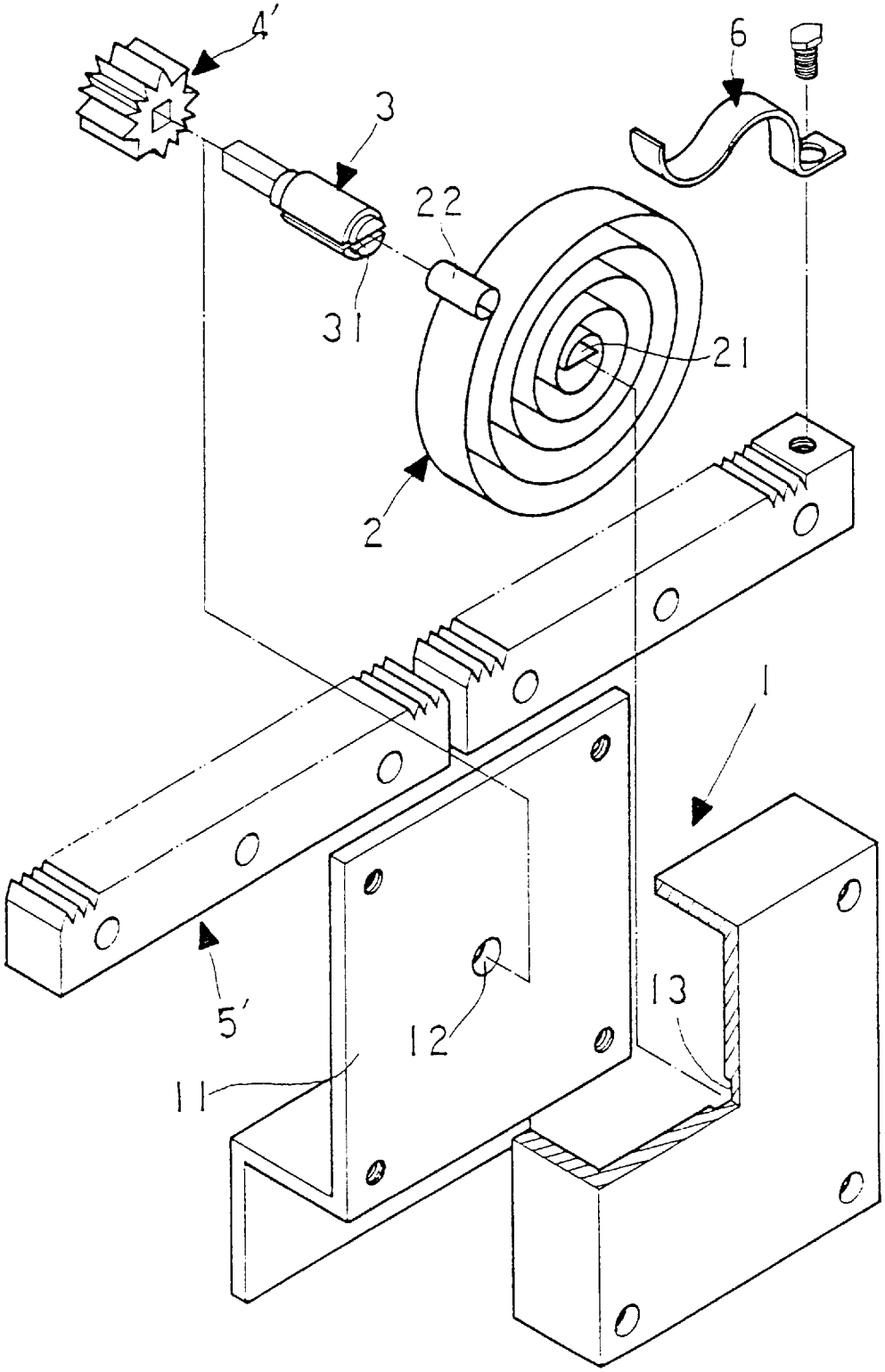
FIG. 4 is an exploded view of a door closer according to a second embodiment of the present invention.
Figure 6:
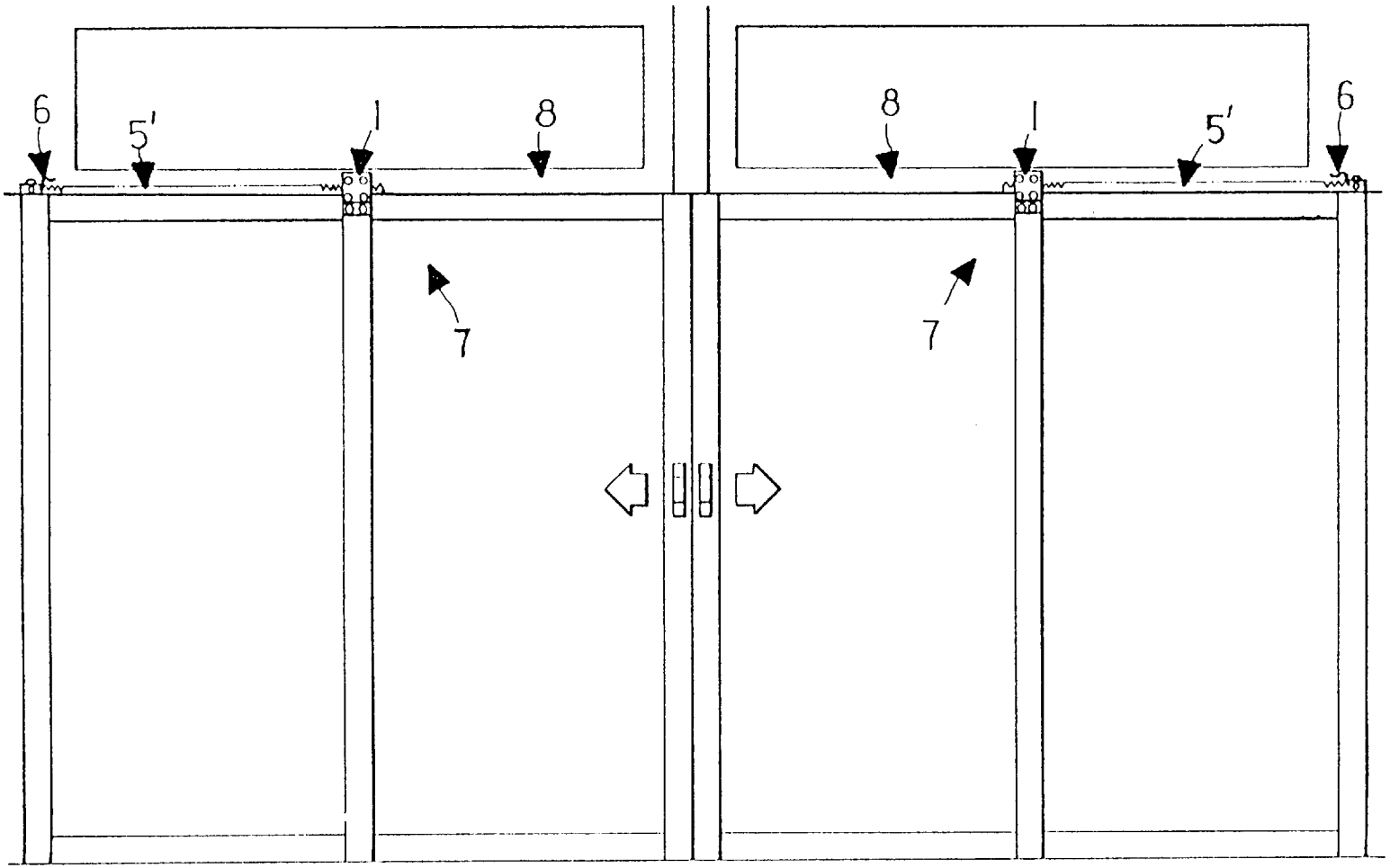
FIG. 6 is an applied view of the present invention, showing the door closer of the second embodiment used with sliding doors.
Figure 7:
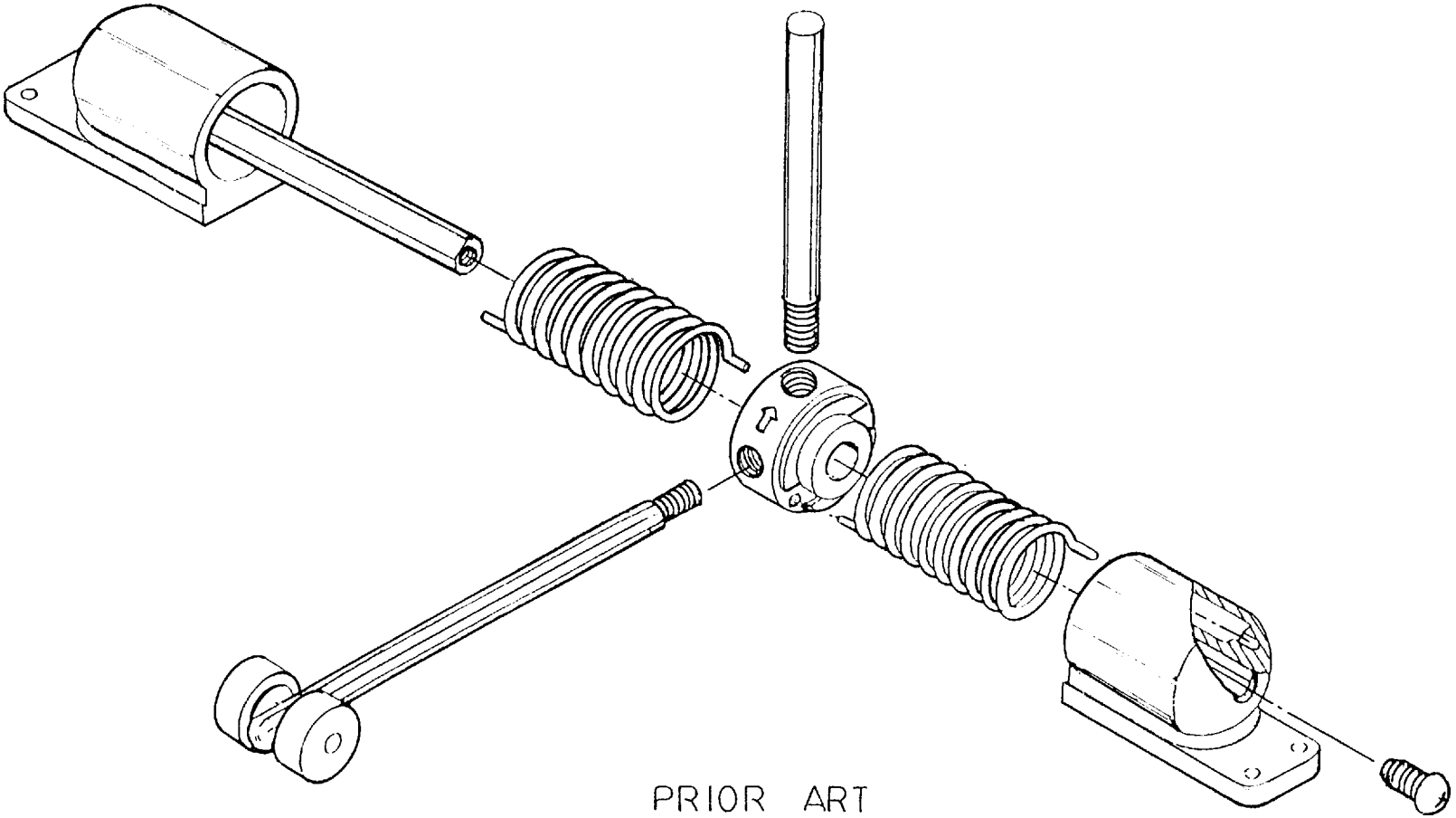
PRIOR ART FIG. 7
FIG. 7 is an exploded view of a door closer according to the prior art.
Figure 8:
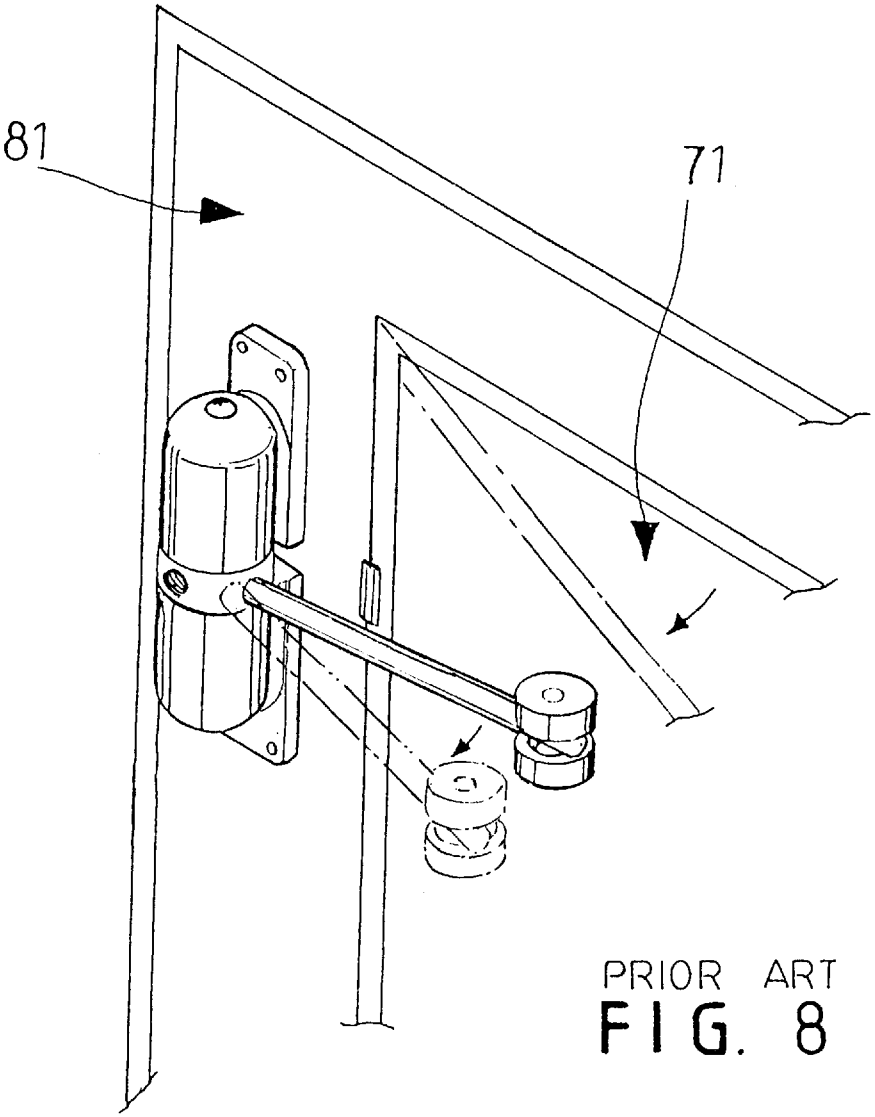
PRIOR ART FIG. 8
FIG. 8 shows the door closer of FIG. 7 installed in a door assembly, and operated.

FIGS. 4, 5 and 6 show an alternate form of the door closer used in a sliding door. According to this alternate form, the door closer is comprised of a casing 1, a spiral spring 2, a shaft 3, a gear 4', a rack 5', and a curved springy holding down plate 6. The casing 1 has an axle bearing 13 on the inside, and an axle hole 12 on the cover 11 thereof. The shaft 3 has one end coupled to the axle bearing 13, and an opposite end extended out of the cover 11 through the axle hole 12. The spiral spring 2 is mounted around the shaft 3 within the casing 1, having an inner end terminating in a flat plug portion 21 fastened to the longitudinal split 31 of the shaft 3, and an outer end terminating into a barrel-like mounting portion 22 fastened with the casing 1 to the door leaf 7. The rack 5' is a toothed straight bar horizontally fastened to the door frame 8, and meshed with the gear 4'. The curved springy holding down plate 6 is fixedly fastened to the rack 5' near one end. When the door leaf 7 is opened, the bevel gear 4' is moved along rack 5', and the shaft 3 is turned with the gear 4 to tighten up the spiral spring 2. When the door leaf 7 is released from the hand, the shaft 3 is turned by the spring force of the spiral spring 2 in the reversed direction, causing the gear 4' to be moved along the rack 5' in the reversed direction, and therefore the door leaf 7 is closed smoothly. Further, when the door leaf 7 is fully opened, the gear 4' is forced into engagement with the curved springy holding down plate 6 (see FIG. 2), and therefor the door leaf 7 is retained in the fully-opened position.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A door closer comprising:

a casing fixedly fastened to a door leaf and covered with a cover, having two axle holes aligned at two opposite sides;

a shaft turned in the axle holes of said casing, said shaft having two annular grooves around the periphery near two opposite ends thereof, and a longitudinal split extended from a middle part thereof to one end;

two clamps respectively mounted on the annular grooves of said shaft to secure said shaft and said casing together, allowing said shaft to be turned in the axle holes of said casing;

a spiral spring mounted within said casing around said shaft, said spiral spring having an inner end terminating in a flat plug portion and fastened to the longitudinal split of said shaft, and an outer end terminating into a barrel-like mounting portion fastened with said casing to said door leaf;

a rack fixedly fastened to a door frame to which said door leaf is hinged, said rack having a 90-degree arc toothed bar section;

a bevel gear fixedly mounted around one end of said shaft and meshed with the 90-degree arc toothed bar section of said rack; and a curved springy holding down plate having a fixed end fixedly fastened to said rack, and a wave-like free end adapted for holding down said bevel gear when said door leaf is opened and said bevel gear is moved from one end of the 90-degree arc toothed bar section of said rack to an opposite end thereof.

2. A door closer comprising:

a casing fixedly fastened to a sliding door leaf, said casing having an axle bearing on the inside, and an axle hole on a cover thereof;

a shaft turned in the axle bearing and axle hole of said casing, said shaft having a longitudinal split at one end;

a spiral spring mounted around said shaft within said casing, said spiral spring having an inner end terminating in a flat plug portion fastened to the longitudinal split of said shaft, and an outer end terminating into a barrel-like mounting portion fastened with said casing to said sliding door leaf;

an elongated rack fixedly and horizontally fastened to a door frame within which sliding door leaf slides, said rack having a toothed straight bar section;

a gear fixedly mounted around one end of said shaft and meshed with the toothed straight bar section of said rack; and a curved springy holding down plate having a fixed end fixedly fastened to said rack, and a wave-like free end adapted for holding down said gear when said sliding door leaf is opened and said bevel gear is moved from one end of the toothed straight bar section of said rack to an opposite end thereof.

* * * * *